US007055326B1

(12) United States Patent
Kalina

(10) Patent No.: US 7,055,326 B1
(45) Date of Patent: Jun. 6, 2006

(54) SINGLE FLOW CASCADE POWER SYSTEM

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 0 days.

(21) Appl. No.: 11/180,049

(22) Filed: Jul. 12, 2005

(51) Int. Cl.
*F01K 25/06* (2006.01)

(52) U.S. Cl. ..... 60/649; 60/651; 60/653; 60/671; 60/679

(58) Field of Classification Search ..... 60/649, 60/651, 653, 671, 679
See application file for complete search history.

(56) References Cited

U.S. PATENT DOCUMENTS 6,158,220 A * 12/2000 Hansen et al. ..... 60/649
6,158,221 A * 12/2000 Fancher et al. ..... 60/649
6,167,705 B1 * 1/2001 Hansen et al. ..... 60/649
6,170,263 B1 * 1/2001 Chow et al. ..... 60/649

* cited by examiner

*Primary Examiner*—Hoang Nguyen
(74) *Attorney, Agent, or Firm*—R W Strozier

(57) ABSTRACT

A cascade power system is disclosed where a single basic working composition (BWC) of a multi-component working fluid stream is fully vaporized in a vaporization subsystem utilizing heat derived from a heat source stream such as a combustion gas stream and energy is extracted from the stream in a multi-stage energy extraction system. The energy extraction subsystem is designed to produce a fully spent BWC stream and a partially spent BWC stream. The fully spend BWC stream is then divided into a fully condensed lean stream and a fully condensed rich stream in a Condensation-Thermal Compression Subsystem. The partially spent stream and stream derived therefrom are used to form a second lean stream and a second rich stream and to heat the fully condensed lean stream and a combined rich stream prior to vaporization.

5 Claims, 2 Drawing Sheets

SINGLE FLOW CASCADE POWER SYSTEM

BACKGROUND OF THE INVENTION

1. Field of the Invention

The present invention relates to a system designed for the utilization of heat produced in the combustion of fuels and the conversion of a portion of the produced heat into useful mechanical and electrical power for extracting usable power from heat produced from the combustion of biomass, agricultural waste (such as bagasse,) municipal waste and other fuels. The present invention also relates to a cascade power system where heat is derived from a hot flue gas stream by mixing the stream with a precooled or partially spent flue gas stream so that the mixed flue gas stream has a desired lower temperature for efficient heating of the working fluid without causing undue stress and strain on the Heat Recovery Vapor Generator.

More particularly, the present invention relates to a cascade power system for extracting usable power from heat produced from the combustion of biomass, agricultural waste (such as bagasse,) municipal waste and other fuels, where the system includes an energy extraction subsystem, a separation subsystem, a heat exchange subsystem, a heat transfer subsystem and a condensing subsystem, where a fully vaporized or superheated single stream is formed from two a fully condensed incoming working fluid streams via heat transfer from a combustion gas stream.

2. Description of the Related Art

In a previous application for a cascade power system, United States patent application Ser. No. 11/099211, filed Apr. 5, 2005, a system designed for the same purposes was introduced in several different variants. However, in all of these variants, two different turbines were utilized, i.e., a high pressure turbine for lean working solution and a separate turbine for rich working solution. Moreover, considering that the rate of expansion of the rich solution in this previous application was quite high, the turbine working with the rich solution would, in most cases, be a multi-stage turbine or in fact consist of two consecutive turbines.

Although several systems have been developed to extract energy from thermal sources using a multiple component working fluid including a cascade system utilizing different working solution compositions, there is still an need in the art for an improved energy extraction system, especially, a system in which the working fluid or solution expanded in a turbine is all of the same composition.

SUMMARY OF THE INVENTION

The present invention provides a cascade power system including a single composition cycle. The system is designed on a modular principle.

The present invention provides a cascade power system including an energy extraction subsystem, a vaporization subsystem, a heat exchange subsystem, and a condensation subsystem. The condensation subsystem produces two streams, lean and rich stream, which are combined along with a third stream derived from an intermediate stage in the energy extraction subsystem to form a single fully vaporized stream of a multi-component working fluid that is then forwarded to the energy extraction subsystem. The rich and lean streams are placed in heat exchange relationships with stream derived from the third stream from the intermediate stage of the energy extraction subsystem and then vaporized in stages with heat derived from a stream of combustion gases from a furnace.

The present invention provides a cascade power system including an energy extraction subsystem, a vaporization subsystem, a heat exchange subsystem, and a condensing subsystem, where the system supports a thermodynamic energy extraction cycle. The energy extraction subsystem extracts energy from a single composition fully vaporized stream in a multi-stage energy extraction subsystem. From an intermediate stage of the energy extraction subsystem, a stream is withdrawn and heat from this stream is used to heat a lean and a rich stream derived from the condensation subsystem. The lean and rich stream from the condensation subsystem after heating and a stream derived from the intermediate stage of the energy extraction subsystem are then combined in stages in the vaporization subsystem where heat from a combustion gas stream is used to fully vaporize the combined stream. The vaporization system does not derive heat directly from an initial combustion gas stream, but is cooled by mixing the initial stream with a portion of the spent combustion stream to produce a combustion gas stream that will not harm the heat exchange elements that comprise the vaporization subsystem. The portion of the cooled combustion stream is slightly pressurized by an fan.

The present invention provides a method including the step of supplying a first lean and first rich fully condensed streams of a multi-component working fluid from a Condensation-Thermal Compression Subsystem (CTCSS). The method also includes the step of diverting a portion of a partially spent stream from an intermediate stage of an energy extraction subsystem and using heat from that stream to heat the lean and rich stream in a series of heat exchange, separation and pressurizing steps and to form a second lean stream and a second rich stream. The second lean stream is then combined with the first lean stream to form a combined stream that is then forwarded to a vaporization subsystem, while the second rich stream is combined with the first rich stream to form a combined rich stream prior to being heated by the diverted partially spent stream. The combined rich stream is then forwarded to a mid portion of the vaporization subsystem and combined with the combined lean stream to form a stream having a basic working composition (BWC). In the vaporization subsystem, the BWC stream is fully vaporized using an external combustion gas stream, which has been formed by mixing an initial combustion gas stream with a portion of a spent combustion gas stream to lower a temperature of the initial combustion gas stream to a temperature that will not harm the equipment comprising the vaporization subsystem. The fully vaporized single composition BWC stream is then forwarded to the energy extraction subsystem where a first portion of it thermal energy from the fully vaporized BWC stream is converted to a first portion of usable energy in a high pressure turbine or turbine stage. The stream is then divided into the diverted stream and a remaining partially spent stream. The remaining partially spent stream is then forwarded to a low pressure turbine or turbine stage and a second portion of thermal energy is converted to a second portion of usable energy. The resulting spent BWC stream is than sent to the CTCSS where the fully condensed first lean stream and fully condensed first rich stream are produced in a series of heat exchange, separation, throttling and pressurizing steps ultimately using external coolant stream.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
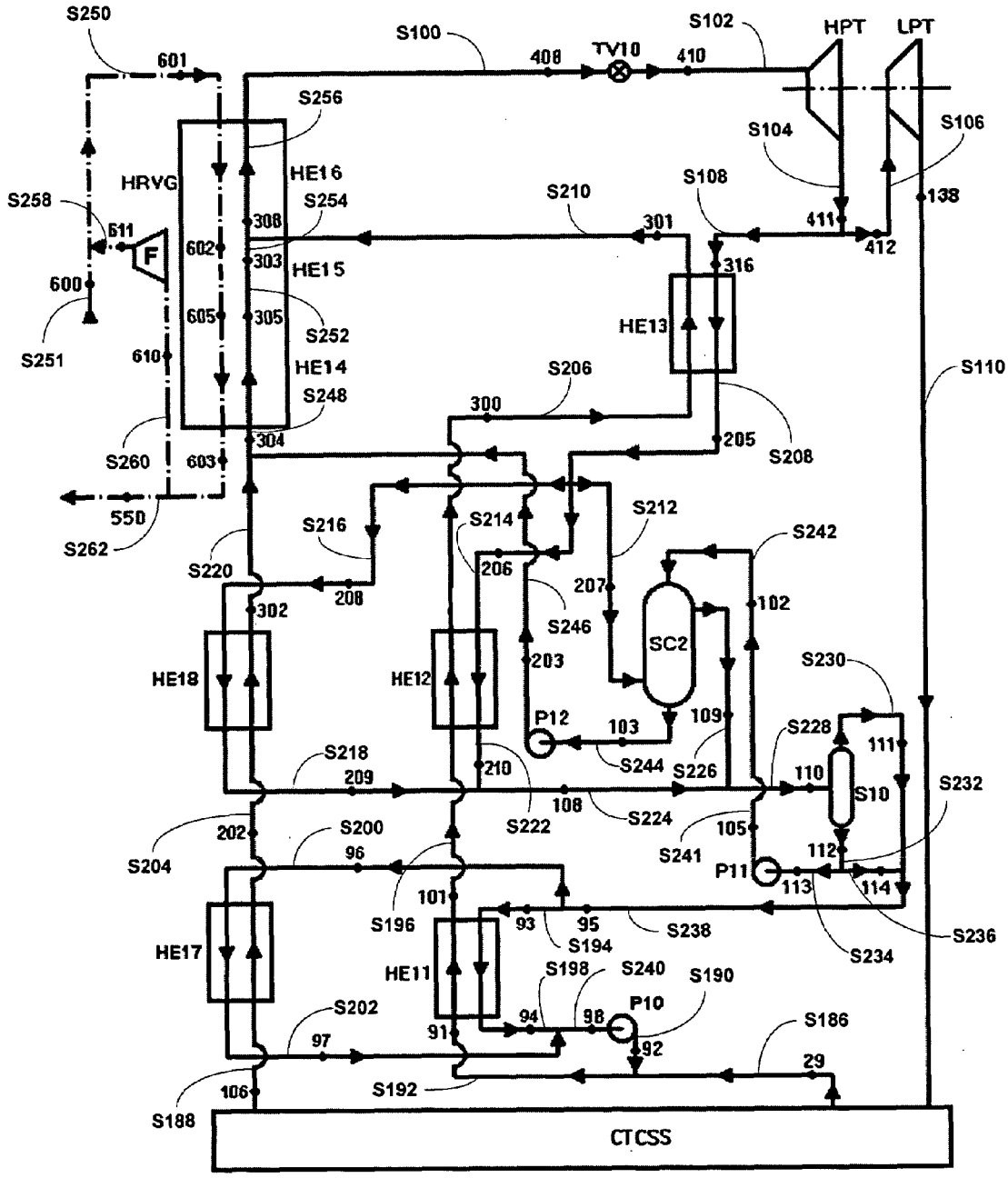
FIG. 1 depicts a block and stream flow diagram of a preferred embodiment of a vaporization subsystem and energy extraction subsystem utilizing four major working solution compositions and a Condensation-Thermal Compression Subsystem (CTCSS)

The inventors have found that a new cascade power extraction system can be constructed where a stream having a single composition of a multi-component working fluid is used in the energy extraction/conversion step. Unlike other cascade power systems, the present cascade power system is designed extract energy from a stream having a single composition in all turbines or turbine stages. The new cascade power system is ideally suited for extracting heat produced in combustion of fuels, especially low heat value fuels such as biomass, agricultural waste (such as bagasse,) municipal waste and other low heat value fuels. For low value fuels, the fuel combustion process is preferably carried out in fluidized bed combustors or combustion zone or other efficient combustion devices designed to handle such low value fuels. The term biomass is used herein to refer to all low heat value fuels, but, of course, the systems of this invention can also be used with other fuels including high heat value fuels such as coal, oil or natural gas.

The present invention broadly relates to a power system including two interacting thermodynamically different working fluid cycles, which are then combined during vaporization to produce a fully vaporized stream of a single composition of a multi-component working fluid, a basic working composition (BWC). The system includes a Condensation-Thermal Compression Subsystem (CTCSS), a vaporization subsystem, an energy extraction subsystem, and a two cycle heating and separating subsystem. The vaporization subsystem is designed to fully vaporize a lean stream and the combined BWC stream. The energy extraction subsystem is designed to convert a portion of thermal energy in the BWC stream to a useable energy. The extraction occurs in two stages with a portion of an intermediate spent stream being diverted to heat a lean and rich stream formed in the CTCSS in the heating and separating subsystem. The CTCSS is designed to convert the spent BWC stream into a fully condensed lean stream and fully condensed rich stream using one or more external coolant streams.

The present invention broadly relates to a method including the step of forming a fully vaporized stream of a basic working composition of a multi-component working fluid in a vaporization subsystem using an external heat source stream, preferably, a combustion gas stream, but any heat source stream can be used. The fully vaporized stream is then forwarded to an energy extraction subsystem where a portion of its thermal energy is converted into a usable form of energy in a two stage process to produce a spent basic working composition stream and a diverted partially spent basic working composition stream. The spent stream is then forwarded to a Condensation-Thermal Compression Subsystem (CTCSS), where the spent stream is divided and cooled in a series of heat exchange, separation, throttling and pressurizing steps to form a fully condensed first lean stream and a fully condensed first rich stream using one or more external coolant stream. The diverted partially spent basic working composition stream is then used to form a second rich stream and a second lean stream. The second rich stream is combined with the first rich stream and subsequently heated by the diverted partially spent basic working composition stream or stream derived therefrom. The first lean stream is then heated by the diverted partially spent basic working composition stream or stream derived therefrom and combined with the second lean stream prior to entering the vaporization subsystem. The combined lean stream is then heated in a lower portion of the vaporization subsystem and then combined with the combined rich stream at a mid-location of the vaporization subsystem. The combined stream, which now has the BWC composition, is then fully vaporized in a top portion of the vaporization subsystem. In the vaporization subsystem, an initial combustion gas stream is mixed with a portion of the spent combustion gas stream to form a combustion gas stream having a temperature below a temperature that cause undue stress on the heat exchange elements of the vaporization subsystem.

The preferred embodiments of the system of this invention are high efficiency systems and high efficiency methods that preferably utilize heat produced in a single stage fluidized bed combustor or combustion zone, but can use heat produced by any method that generates a hot flue gas effluent stream.

The system of this invention uses as its working fluid including a mixture of at least two components, where the components have different normal boiling temperatures. That is the working fluid is a multi-component fluid including at least one higher boiling component and at least one lower boiling component. In a two component working fluid, the higher boiling component is often referred to simply as the high boiling component, while the lower boiling component is often referred to simply as the low boiling component. A composition of the multi-component working fluid is varied throughout the system with energy being extracted from a rich working fluid and a lean working fluid, where rich means that the fluid has a higher concentration of the low boiling component than the in-coming working fluid and lean means that the fluid has a lower concentration of the low boiling component than the in-coming working fluid.

The working fluid used in the systems of this inventions is a multi-component fluid that comprises a lower boiling point material—the low boiling component—and a higher boiling point material—the high boiling component. Preferred working fluids include, without limitation, an ammonia-water mixture, a mixture of two or more hydrocarbons, a mixture of two or more freons, a mixture of hydrocarbons and freons, or the like. In general, the fluid can comprise mixtures of any number of compounds with favorable thermodynamic characteristics and solubilities. In a particularly preferred embodiment, the fluid comprises a mixture of water and ammonia.

Suitable heat transfer fluids include, without limitation, metal fluids such as lithium, sodium, or other metal used as high temperature heat transfer fluids, synthetic or naturally derived high temperature hydrocarbon heat transfer fluids, silicon high temperature heat transfer fluids or any other heat transfer fluid suitable for use with hot flue gas effluent stream from fuel combustion furnaces, where the fuel includes biomass, agricultural waste (such as bagasse,) municipal waste, nuclear, coal, oil, natural gas and other fuels.

Figure 2:
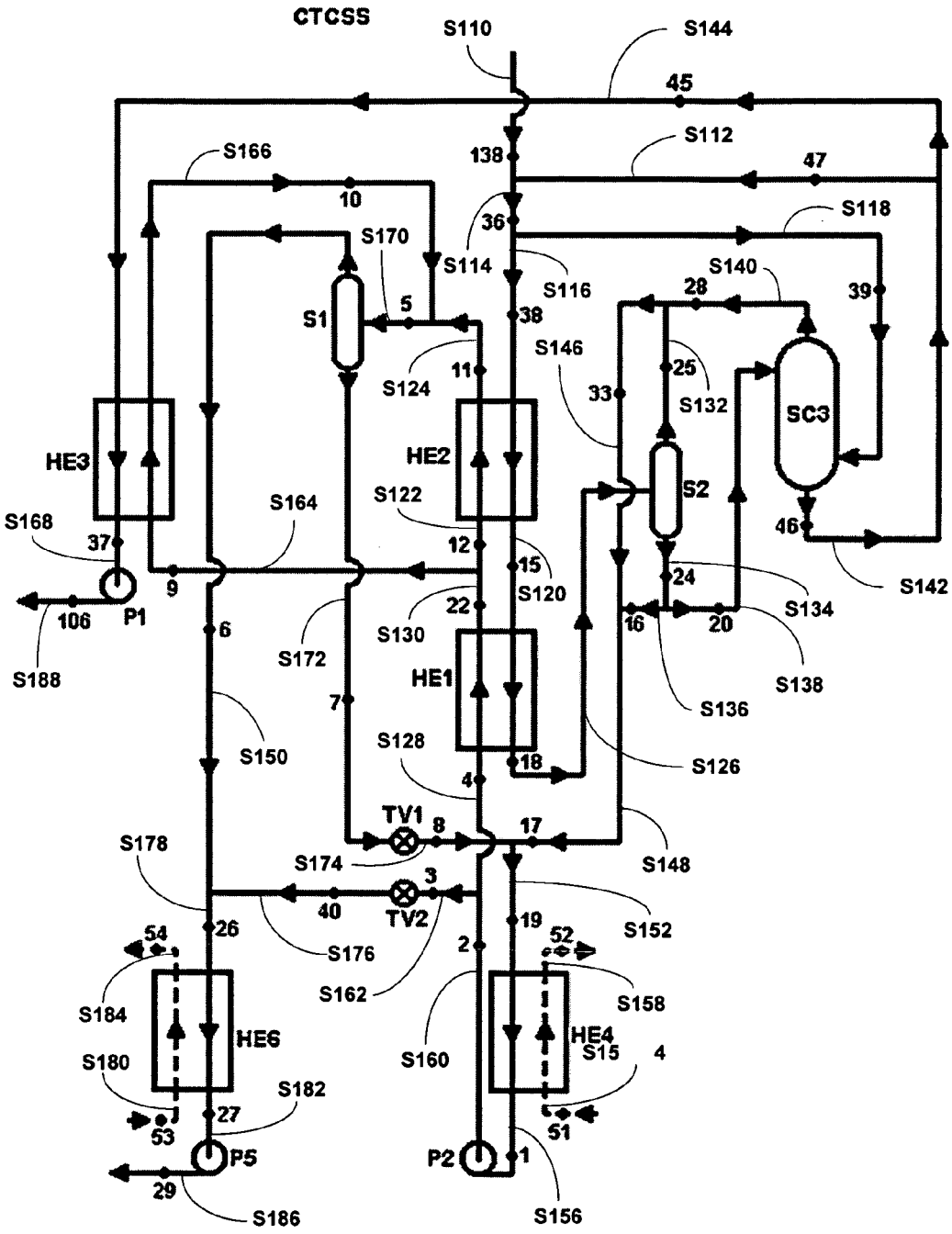
FIG. 2 depicts a block and stream flow diagram of a preferred embodiment of a Condensation-Thermal Compression Subsystem (CTCSS).

The system of this invention comprises a main system as shown in FIG. 1, and a specific Condensation-Thermal Compression Subsystem (CTCSS) as shown in FIG. 2.

PREFERRED EMBODIMENTS

Referring now to FIG. 1, a high pressure, superheated working fluid stream S100 having parameters as at a point 408, which has a composition referred to as a basic working composition (BWC), passes through an admission valve TV10 to form a stream S102 having parameters as at a point 410. The stream S102 having the parameters as at the point 410, then enters into a high pressure turbine HPT, where it is expanded to an intermediate pressure, producing work, and forming a stream S104 having parameters as at a point 411. Thereafter, the stream S104 having the parameters as at the point 411 is divided into two substreams S106 and S108 having parameters as at points 412 and 316, respectively.

The substream S106 having the parameters as at the point 412 is then sent into a low pressure turbine LPT, where it is fully expanded, producing work, and forming a spent stream S110 having parameters as at a point 138.

The stream S110 having the parameters as at the point 138 then enters the CTCSS as shown in FIG. 2. The state of the working fluid stream S110 having the parameters as at the point 138 is usually that of superheated vapor, but in some cases, could be in a state of saturated or even wet vapor. If the state of working fluid stream S110 having the parameters as at the point 138 corresponds to a state of superheated vapor, then the vapor is mixed with a stream of lean liquid S112 having parameters as at a point 47, forming a stream of saturated vapor S114 having parameters as at a point 36. If the stream S110 having the parameters as at the point 138 is in a state of saturated or wet vapor, then the flow rate of the stream S112 having parameters as at the point 47 is equal to zero, and the parameters of the working fluid stream S114 having the parameters as at the point 36 are the same as the parameters of the stream S110 having the parameters as at the point 138.

Thereafter, the stream S114 having the parameters as at the point 36 is divided into two substreams S116 and S118 having parameters as at points 38 and 39, respectively. The stream S116 having the parameters as at the point 38, then passes through a second heat exchanger HE2, where it is partially condensed, releasing heat, and forms a stream S120 having parameters as at a point 15. The heat released in a second heat release process 38-15 is used for boiling of a counterflow stream S122 having parameters as at a point 12 in a second heat absorption process 12-11 to form a heated stream S124 having parameters as a point 11. The second heat release process 38-15 and the second heat absorption process 12-11 are two components of a second heat exchange process that occurs in the heat exchanger HE2.

Thereafter, the stream S120 having the parameters as at the point 15 passes though a first heat exchanger HE1, where the stream S120 is further condensed, releasing heat, and forming a stream S126 having parameters as at a point 18. The heat released in a first heat release process 15-18 is used to preheat an upcoming counterflow stream S128 having parameters as at a point 4 in a first heat absorption process 4-22 to form a heated stream S130 having parameters as at a point 22. The first heat release process 15-18 and the first heat absorption process 4-22 are two components of a first heat exchange process that occurs in the heat exchanger HE1.

The stream S126 having the parameters as at the point 18 is then sent into a second gravity separator S2, where the stream S126 is separated into a stream of saturated vapor S132 having parameters as at a point 25, and a stream of saturated liquid S134 having parameters as at a point 24.

The stream of saturated liquid S134 having the parameters as at the point 24 is then divided into two substream S136 and S138 having parameters as at points 16 and 20, respectively. The stream S138 having the parameters as at the point 20 is then sent to a top portion of a direct contact heat and mass exchanger such as a scrubber SC3. Simultaneously, the stream of vapor S118 having the parameters as at the point 39 as described above, is introduced into a bottom portion of the scrubber SC3. As a result of the mass and heat exchange that occurs in the scrubber SC3 between streams S118 and S138 having the parameters as at the points 39 and 20, a stream of saturated vapor S140 having parameters as at a point 28 and a stream of saturated liquid S142 having parameters as at a point 46 are produced and removed from the scrubber SC3.

The stream of saturated vapor S140 having the parameters as at the point 28 has a much higher concentration of a light-boiling component, i.e., is "richer", than the vapor stream S118 having the parameters as at the point 39. Also, the stream of saturated liquid S142 having the parameters as at the point 46 has a much lower concentration of the light-boiling component, i.e., is "leaner", than the stream of saturated liquid S138 having the parameters as at the point 20.

The stream of lean liquid S142 having the parameters as at the point 46 is then divided into two substreams S144 and S112 having parameters as at points 45 and 47, respectively. The stream S112 having the parameters as at the point 47 is then mixed with the stream S110 of BWC having the parameters as at the point 138 as described above.

Meanwhile, the stream of vapor S140 having the parameters as at the point 28 is combined with the stream of vapor S132 having the parameters as at the point 25 from the separator S2 as described above, forming a stream of vapor S146 having parameters as at a point 33. The stream S146 having the parameters as at the point 33 is then combined with the stream of saturated liquid S136 having parameters as at the point 16 as described above, forming a stream S148 having parameters as at a point 17. The composition of the stream S148 having the parameters as at the point 17 will hereafter be referred to as a "rich working solution" (RWS). Thereafter, the stream S148 of RWS having the parameters as at the point 17 is mixed with a stream S150 of lean solution having parameters as at a point 8, forming a stream S152 having parameters as at a point 19. The composition of the stream S152 having the parameters as at the point 19 as "basic composition." Thereafter, the stream S152 of basic composition having the parameters as at the point 19 passes through a fourth heat exchanger or a condenser HE4, where the stream S152 is cooled in counterflow with a stream S154 of coolant (air or water) having parameters as at a point 51 in a heat absorption process 51-52, and is fully condensed, forming a stream S156 of parameters as at a point 1 and the coolant stream S154 is heated to form a waste coolant stream S158 having parameters as at a point 52.

The stream S154 of basic composition having the parameters as at the point 1 is then sent into a circulating pump P2, where its pressure is increased forming a higher pressure stream S160 having parameters as at a point 2. The stream S160 having the parameters as at a point 2 is then divided into two substreams S162 and S128 with parameters as at points 3 and 4, respectively.

The stream S128 of basic solution having the parameters as at the point 4 is then sent into the first heat exchange HE1, where it is heated in counterflow with the stream S120 in a first heat exchange process as described above forming a stream S130 having the parameters as at the point 22, which corresponds to or is close to a state of saturated liquid. Thereafter, the stream S130 having the parameters as at the point 22 is divided into two substreams S164 and S122 having parameters as at points 9 and 12, respectively.

The stream S122 having the parameters as at the point 12 is then sent into the second heat exchanger HE2, where it is partially boiled in counterflow with stream S116 having the parameters as at the point 38 in a second heat exchange process as described above forming the stream S124 having the parameters as at the point 11.

At the same time, the stream S164 having the parameters as at the point 9 is sent into a third heat exchanger HE3, where it is partially vaporized forming a stream S166 having parameters as at a point 10 in a third heat releasing process 9-10. The stream S144 of lean liquid having the parameters as at the point 45 is sent into the third heat exchanger HE3, where it is cooled, in counterflow with the stream S164 having the parameters as at the point 9 in a third heat absorption process 45-37 forming a stream S168 having parameters as at a point 37. The third heat releasing and absorption processes combine to form a third heat exchange process.

The stream S166 having the parameters as at the point 10 is then combined with the stream S124 having the parameters as at the point 11 as described above, forming a stream S170 having parameters as at a point 5. It should be noted that the composition of the streams S156, S160, S162, S128, S130, S164, S122, S124, S166 and S170 having parameters as at points 1, 2, 3, 4, 22, 9, 12, 11, 10 and 5 is the same as the stream S152 the basic composition as at the point 19.

The stream S172 of basic composition having the parameters as at the point 5, which is in a state of a liquid-vapor mixture, enters into a first gravity separator S1, where it is separated into a stream of rich saturated vapor S150 having the parameters as at the point 6, and a stream of lean saturated liquid S172 having parameters as at a point 7.

The liquid stream S174 having the parameters as at the point 7 is then sent into a first throttle valve TV1, where its pressure is reduced forming a stream S174 having parameters as at a point 8, and then is mixed with the stream of vapor S148 having the parameters as at the point 17, forming the stream S152 of basic composition having the parameters as at the point 19 as described above.

Meanwhile, the stream S162 of basic solutions having the parameters as at the point 3 as described above, is sent though a second throttle valve TV2, where its pressure is reduced to a level equal to a pressure of the stream S150 having the parameter as at the point 6 forming a stream S176 having parameters as at a point 40. Then the stream S176 having the parameters as at the point 40 is combined with the stream S150 having the parameters as at the point 6, forming a stream of RWS with parameters as at point 26. The composition and flow rate of the stream at point 26 is at point 17.

The stream S178 of RWS having parameters as at a point 26 is then sent through a high pressure condenser or a sixth heat exchanger HE6 in a heat releasing process 26-27, where it is cooled in counterflow with a second coolant stream S180 (air or water) having parameters as at a point 53 in a heat absorption process 53-54 forming a fully condensed stream S182 having parameters as at a point 27 and a waste heated second coolant stream S184 having parameters as at a point 54.

As a result of the operation of the CTCSS, the stream S110 of BWC having the parameters as at the point 138 has been separated into two streams, i.e., a rich working solution stream S182 having the parameters as at the point 27 and the stream S168 of lean liquid having the parameters as at the point 37 as described above.

Thereafter the streams S182 and S168 having the parameters as at the points 27 and 37, respectively, are sent into a five pump P5 and a first pump P1, respectively, where they are pumped to a necessary higher pressure to form streams S186 and S188 having parameters as at points 29 and 106, respectively.

A liquid stream S190 having the parameters as at a point 92 as describe below, which has the same composition as stream S186 having the parameter as at the point 29 discharged from the CTCSS, forming a stream S192 having parameters as at a point 91. The stream S192 having the parameters as at the points 91 then enter into an eleventh heat exchanger HE11, where it is heated in a heat absorbing process 91-101 by a condensing stream S194 of RWS having parameters as at a point 93 in a heat releasing process 93-94 as described below to form a stream S196 having parameters as at a point 101 and a cooled stream S198 having parameters as at a point 94. The heat releasing process 94-94 and the heat absorbing process 91-101 form an eleventh heat exchange process that occurs in the eleventh heat exchanger HE11. The stream S196 having the parameters as at the point 101 corresponds to or close to a state of saturated liquid. The stream S188 having the parameters as at the point 106, then enters into a seventeenth HE17, where it is heated in a heat absorbing process 106-202 by a condensing stream S200 of RWS having parameters as at a point 96, to form a condensed stream S202 having parameters as at a point 97. As a result, the stream S188 having the parameters as at the point 106 to form a stream S204 having parameters as at a point 202, corresponding to a state of subcooled liquid.

The stream S108 of partially expanded BWC having the parameters as at the point 316 as described above passes through a thirteenth heat exchanger HE13 in a thirteenth heat exchange process comprising a heat absorbing process 300-301 and a heat releasing process 316-205, where the stream S108 is cooled in counterflow with a stream S206 having parameters as a point 300 forming a stream S208 having parameters as at a point 205, corresponding or close to a state of saturated vapor and a heated stream S210 having parameters as a point 301. Thereafter, the stream S208 having the parameters as at the point 205 is divided into three substreams S212, S214 and S216 having parameters as at points 207, 206, and 208, respectively.

The stream S216 having the parameters as at the points 208 is sent into an eighteenth heat exchanger HE18 in an eighteenth heat exchange process comprising a heat releasing process 208-209 and a heat absorbing process 202-302, forming a partially condensed stream S218 having parameters as at points 209 and a heated stream S220 having parameters as at a point 302. The stream S214 having the parameters as at the points 206 is sent into a twelveth heat exchanger HE12 in an eighteenth heat exchange process comprising a heat releasing process 206-210 and a heat absorbing process 101-300, forming a partially condensed stream S222 having parameters as at a 210 and a heated stream S206 having the parameters as at the point 300.

Thereafter, the streams S218 and S222 of partially condensed BWC having the parameters as at the points 209 and 210 are combined, forming a stream S224 of BWC with parameters as at a point 108. The stream S224 having the parameters as at the point 108 is then combined with a stream S226 of vapor having parameters as at a point 109 as described below, forming a stream S228 having parameters as at a point 110. The stream S228 having the parameters as at the point 110 then enters into a tenth gravity separator S10, where it is separated into a stream S230 of saturated vapor having parameters as at a point 111 and a stream S232 of saturated liquid having parameters as at a point 112. The pressure and temperature of the stream S228 having the parameters at the point 110 is chosen in such a way that a composition of the vapor stream S230 having the parameters as at the point 111 is richer, or at least equal in richness to the composition of RWS (Rich Working Solution) streams. Thereafter, the stream S232 of saturated liquid with parameters as at point 112 is divided into two substreams S234 and S236 having parameters as at points 113 and 114, respectively.

The stream S236 of liquid having the parameters as at the point 114 is combined with the stream S230 of saturated vapor having the parameters as at the point 111 as described above, forming a stream S238 having parameters as at a point 95. The flow rate of stream S236 having the parameters as at the point 114 is chosen in such a way that a composition of the stream S238 having the parameters as at the point 95 is equal to the composition of the streams of RWS. Thereafter, the stream S238 having the parameters as at the point 95 is divided into the two substreams S194 and S200 having the parameters as at the points 93 and 96, respectively. The streams with parameters as at points 93 and 96 are sent into heat exchangers HE11 and HE17 (see above), where these streams are fully condensed, releasing heat for processes 91-101 and 106-202, and obtain parameters as at points 94 and 97, respectively. Thereafter, the streams S198 and S202 having the parameters as at the point 94 and 97 are combined, forming a stream S240 of saturated liquid having parameters as at a point 98. The stream S240 having the parameters as at the point 98 is then sent into a tenth pump P10, where it is pumped to a pressure equal to the pressure of the stream S186 having the parameters as at the point 29 as described above forming the stream S190 having the parameters as at the point 92. The stream S190 having the parameters as at the point 92 is then combined with the stream S186 having the parameters as at the point 29, forming the stream S192 of RWS having the parameters as at the point 91 as described above.

The stream S234 of saturated liquid having the parameters as at the point 113 is sent into an eleventh pump P1, where its pressure is slightly increased to form a stream S241 having parameters as at a point 105. The pressure increase is designed to raise the pressure of the stream S242 to a pressure at a top of a second scrubber SC2. After being lifted to the top of second scrubber SC2, the stream S242 having parameters as at a point 102.

Meanwhile, the stream S212 of saturated vapor having the parameters as at the point 207 as described above, enters into a bottom portion of the second scrubber SC2. As a result of mass and heat exchange between streams S212 and S242 having the parameters as at the points 207 and 102, respectively, the stream S226 having the parameters as at the point 109, which is in the state of a saturated vapor and a saturated liquid stream S244 having parameters as at a point 103 are produced. The composition of the vapor stream S226 having the parameters as at the point 109 is substantially richer than the composition of vapor stream S212 having the parameters as at the point 207, whereas the composition of the liquid stream S244 having the parameters as at the point 103 is substantially leaner the composition of the liquid stream S242 having the parameters as at the point 102. The stream S226 of vapor having the parameters as at the point 109 is then combined with the stream S224 of BWC having the parameters as at the point 108, forming the stream S228 having the parameters as at the point 110 as describe above.

The stream S196 of RWS having the parameters as at the point 101 as described above, passes through the twelveth heat exchanger HE12, where it is fully vaporized in the twelveth heat exchange process as described above forming the stream S206 having the parameters as at the point 300, corresponding to or close to a state of saturated vapor. The stream S204 of lean liquid having the parameters as at the point 202 as described above passes through the eighteenth heat exchanger HE18, where it is heated in the twelveth heat exchange process forming the stream S220 having the parameters as at the point 302.

The stream S244 of lean liquid having the parameters as at the point 103 exits from the second scrubber SC2 and is sent into a twelveth pump P12, where its pressure is increased to form a stream S246 having parameters as at a point 203 having a pressure equal to a pressure of the stream S220 having the parameters as at the point 302. The stream S246 having the parameters as at the point 203 is then combined with the stream S220 having the parameters as at the point 302, forming a stream S248 with parameters as at point 304, corresponding to a state of subcooled liquid. The stream S248 of liquid having the parameters as at the point 304 is then sent into a Heat Recovery Vapor Generator HRVG, where it is heated in counterflow by a stream S250 of combustion gases having parameters as a point 605 as described below producing a stream S252 having parameters as at a point 305, which correspond to a state of saturated liquid, while the stream S250 of combustion gases acquires parameters as at a point 603.

Meanwhile, the stream S206 of saturated RWS vapor having the parameters as at the point 300 passes through the thirteenth heat exchanger HE13, where it is heated in counterflow by stream S108 as described above forming the stream S210 having the parameters as at the point 301, which corresponds to a state of superheated vapor.

The stream of saturated liquid in the HRVG with parameters as at point 305 is then partially vaporized in counterflow with the combustion gases stream S250 of combustion gas having parameters as at a point 602 as described below forming a stream S254 having parameters as at a point 303, while the combustion gases stream S250 acquires parameters as at the point 605. Thereafter, the streams S254 and S210 having the parameters as at the points 301 and 303, respectively, are combined, forming a stream S256 of BWC having parameters as at a point 308. The parameters of the stream S254 at the point 303 are chosen in such a way that after mixing the stream S254 having the parameters as at the point 303 with the superheated vapor of stream S210 having the parameters as at the point 301, the resulting stream S256 having the parameters as at the point 308 is in a state of saturated or slightly superheated vapor. Thereafter, the stream S256 having the parameters as at the point 308 is superheated in counterflow with the stream S250 of combustion gases having parameters as at a point 601 forming the vapor stream S100 having the parameters as at the point 408, while the stream S250 acquires parameters as at a point 602 as described below. It should be recognized that the working fluid cycle is closed cycle.

Combustion gas, which is the heat source for the operation of the system of this invention, enters the system from a combustor (not shown), as an initial combustion gas stream S251 having parameters as at point 600. The temperature of the combustion gas stream S251 at the point 600 is usually too high for this gas to be introduced directly into the HRVG. Therefore, the initial combustion gas stream S251 having the parameters as at the point 600 is first mixed with a stream S258 of pressurized and cooled combustion gas having parameters as at a point 611 as described below. The stream S258 is derived from the combustion gas stream S250 after it has been cooled while transferring its heat to the streams S248, S252, S254 and S256 having the parameters as at the points 304, 305, 303, and 308, respectively. This cooled combustion gas stream S258 when combined with the initial combustion gas stream S251 forms the combustion gas stream S250 having parameters as at a point 601. In this way, the temperature of the combustion gas stream S250 at the point 601 can be controlled for safe introduction into the HRVG. The stream S250 of combustion gas with the parameters as at the point 601 then enters into the HRVG where it is cooled consecutively in heat releasing processes 601-602, 602-605 and 605-603 coupled to corresponding heat absorbing process 308-408, 303-308, 305-303 and 304-305, respectively and exits the HRVG having the parameters as at the point 603.

The portion of the HRVG corresponding to process 601-602 vs. 308-408 is designated as a sixteenth heat exchanger HE16. The portion of the HRVG corresponding to process 602-605 vs. 305-303 is designated as a fifthteen heat exchanger HE15. The portion of the HRVG corresponding to process 605-603 vs. 304-305 is designated as a fourteenth heat exchanger HE14.

The combustion gas stream S250 exits the HRVG having the parameters as at the point 603 is divided into two substreams S260 and S262 having parameters as at points 610 and 550 correspondingly. The substream S260 of cooled combustion gases having the parameters as at the point 610 is then sent into a high temperature recirculating fan F, where its pressure is slightly increased to form the stream S258 having the parameters as at the point 611, and is thereafter mixed with the incoming stream S251 of combustion gas having the parameters as at the point 600 as described above.

The stream S262 of combustion gas having the parameters as at the point 550, which has a flow rate equal to the flow rate of the initial combustion gas stream S251 having the parameters as at the point 600, is now returned to the combustion subsystem.

The system of this invention is simpler and less expensive than earlier variants of cascade systems that were the subjects of prior applications; it requires only two turbines or two stages of one turbine and utilized a single compositional working fluid solution is each of the turbines or in each of the turbine stages.

TABLE 1

Performance Summary for Ammonia/Water Working Solution

| Performance Data | | |
|---|---|---|
| Heat in | 4,573.17 kW | 2,449.81 Btu/lb |
| Heat rejected | 2,832.31 kW | 1,517.25 Btu/lb |
| Turbine enthalpy Drops | 1,845.87 kW | 988.82 Btu/lb |
| Gross Generator Power | 1,760.13 kW | 942.89 Btu/lb |
| Process Pumps (−42.93) | −89.65 kW | −48.03 Btu/lb |
| Cycle Output | 1,670.48 kW | 894.86 Btu/lb |
| Other Pumps and Fans (−3.31) | −6.95 kW | −3.72 Btu/lb |
| Net Output | 1,663.52 kW | 891.14 Btu/lb |
| Gross Generator Power | 1,760.13 kW | 942.89 Btu/lb |
| Cycle Output | 1,670.48 kW | 894.86 Btu/lb |
| Net Output | 1,663.52 kW | 891.14 Btu/lb |
| Net thermal efficiency | 36.38% | |
| Second Law Limit | 65.87% | |
| Second Law Efficiency | 55.22% | |

TABLE 2

System Point Summary for Ammonia/Water Working Fluid

| Pt. | X lb/lb | T ° F. | P psia | H Btu/lb | S Btu/lb-R | Ex Btu/lb | G rel G/G = 1 | Ph. lb/lb | Wetness or T ° F. |
|---|---|---|---|---|---|---|---|---|---|
| Working Fluids | | | | | | | | | |
| 1 | 0.4079 | 65.80 | 21.900 | −69.2834 | 0.0189 | 0.1953 | 3.79730 | Mix | 1 |
| 2 | 0.4079 | 66.05 | 102.059 | −68.8181 | 0.0192 | 0.4741 | 3.79730 | Liq | −83.89° F. |
| 3 | 0.4079 | 66.05 | 102.059 | −68.8181 | 0.0192 | 0.4741 | 0.19747 | Liq | −83.89° F. |
| 4 | 0.4079 | 66.05 | 102.059 | −68.8181 | 0.0192 | 0.4741 | 3.59984 | Liq | −83.89° F. |
| 5 | 0.4079 | 201.42 | 98.059 | 226.7049 | 0.5028 | 45.1844 | 3.59984 | Mix | 0.7771 |
| 6 | 0.9089 | 201.42 | 98.059 | 680.5967 | 1.2786 | 98.9299 | 0.80253 | Mix | 0 |
| 7 | 0.2641 | 201.42 | 98.059 | 96.4860 | 0.2802 | 29.7651 | 2.79730 | Mix | 1 |
| 8 | 0.2641 | 140.30 | 23.900 | 96.4860 | 0.2881 | 25.6896 | 2.79730 | Mix | 0.9137 |
| 9 | 0.4079 | 148.63 | 100.059 | 21.3915 | 0.1785 | 8.0576 | 0.17992 | Mix | 1 |
| 10 | 0.4079 | 200.42 | 98.059 | 222.9380 | 0.4971 | 44.3751 | 0.17992 | Mix | 0.7808 |
| 11 | 0.4079 | 201.47 | 98.059 | 226.9031 | 0.5031 | 45.2271 | 3.41991 | Mix | 0.7769 |
| 12 | 0.4079 | 148.63 | 100.059 | 21.3915 | 0.1785 | 8.0576 | 3.41991 | Mix | 1 |
| 15 | 0.4951 | 153.63 | 24.900 | 353.4610 | 0.7773 | 29.9265 | 1.28903 | Mix | 0.5354 |
| 16 | 0.3520 | 87.18 | 23.900 | −40.5094 | 0.0670 | 3.7738 | 0.27769 | Mix | 1 |
| 17 | 0.8100 | 87.73 | 23.900 | 415.3891 | 0.9600 | −1.4505 | 1.00000 | Mix | 0.2774 |
| 18 | 0.4951 | 87.18 | 23.900 | 101.5347 | 0.3452 | 2.1214 | 1.28903 | Mix | 0.7746 |
| 19 | 0.4079 | 129.68 | 23.900 | 180.4674 | 0.4673 | 17.3678 | 3.79730 | Mix | 0.7481 |
| 20 | 0.3520 | 87.18 | 23.900 | −40.5094 | 0.0670 | 3.7738 | 0.72078 | Mix | 1 |
| 22 | 0.4079 | 148.63 | 100.059 | 21.3915 | 0.1785 | 8.0576 | 3.59984 | Mix | 1 |
| 24 | 0.3520 | 87.18 | 23.900 | −40.5094 | 0.0670 | 3.7738 | 0.99847 | Mix | 1 |

TABLE 2-continued

System Point Summary for Ammonia/Water Working Fluid

| Pt. | X lb/lb | T ° F. | P psia | H Btu/lb | S Btu/lb-R | Ex Btu/lb | G rel G/G = 1 | Ph. lb/lb | Wetness or T ° F. |
|---|---|---|---|---|---|---|---|---|---|
| 25 | 0.9868 | 87.18 | 23.900 | 589.6612 | 1.3015 | −3.5573 | 0.29055 | Mix | 0 |
| 26 | 0.8100 | 188.74 | 98.059 | 546.1995 | 1.0570 | 79.0036 | 1.00000 | Mix | 0.1961 |
| 27 | 0.8100 | 65.80 | 96.059 | −22.6679 | 0.0460 | 34.5507 | 1.00000 | Mix | 1 |
| 28 | 0.9856 | 89.18 | 23.900 | 591.3333 | 1.3044 | −3.3893 | 0.43175 | Mix | 0 |
| 29 | 0.8100 | 74.31 | 2,075.000 | −8.9793 | 0.0560 | 43.0535 | 1.00000 | Liq | −271.97° F. |
| 33 | 0.9861 | 88.39 | 23.900 | 590.6607 | 1.3033 | −3.4581 | 0.72231 | Mix | 0 |
| 36 | 0.4951 | 207.42 | 25.900 | 898.7033 | 1.6172 | 139.5374 | 1.72825 | Vap | 0° F. |
| 37 | 0.0627 | 153.63 | 15.900 | 98.1520 | 0.2211 | 61.1648 | 0.68157 | Liq | −25.76° F. |
| 38 | 0.4951 | 207.42 | 25.900 | 898.7033 | 1.6172 | 139.5374 | 1.28903 | Vap | 0° F. |
| 39 | 0.4951 | 207.42 | 25.900 | 898.7033 | 1.6172 | 139.5374 | 0.43923 | Vap | 0° F. |
| 40 | 0.4079 | 0.00 | 98.059 | 0.0000 | 0.0000 | 0.0000 | 0.19747 | Mix | 0 |
| 45 | 0.0627 | 205.42 | 25.900 | 151.3572 | 0.3044 | 71.2015 | 0.68157 | Mix | 1 |
| 46 | 0.0627 | 205.42 | 25.900 | 151.3572 | 0.3044 | 71.2015 | 0.72825 | Mix | 1 |
| 47 | 0.0627 | 205.42 | 25.900 | 151.3572 | 0.3044 | 71.2015 | 0.04668 | Mix | 1 |
| 91 | 0.8100 | 164.65 | 2,075.000 | 95.2398 | 0.2362 | 53.8130 | 2.18533 | Liq | −181.63° F. |
| 92 | 0.8100 | 235.85 | 2,075.000 | 183.1640 | 0.3694 | 72.6175 | 1.18533 | Liq | −110.42° F. |
| 93 | 0.8100 | 367.43 | 823.470 | 759.4551 | 1.1511 | 243.4808 | 0.98519 | Mix | 0.0047 |
| 94 | 0.8100 | 228.20 | 821.470 | 175.0288 | 0.3671 | 65.6767 | 0.98519 | Mix | 1 |
| 95 | 0.8100 | 367.43 | 823.470 | 759.4551 | 1.1511 | 243.4808 | 1.18533 | Mix | 0.0047 |
| 96 | 0.8100 | 367.43 | 823.470 | 759.4551 | 1.1511 | 243.4808 | 0.20014 | Mix | 0.0047 |
| 97 | 0.8100 | 228.20 | 821.470 | 175.0288 | 0.3671 | 65.6767 | 0.20014 | Mix | 1 |
| 98 | 0.8100 | 228.20 | 821.470 | 175.0288 | 0.3671 | 65.6767 | 1.18533 | Mix | 1 |
| 101 | 0.8100 | 345.43 | 2,065.000 | 358.7114 | 0.6022 | 127.4147 | 2.18533 | Mix | 1 |
| 102 | 0.3405 | 367.63 | 825.470 | 286.1125 | 0.5406 | 84.6667 | 1.04555 | Liq | −0.12° F. |
| 103 | 0.1675 | 442.43 | 826.470 | 394.6616 | 0.6422 | 139.7438 | 1.05716 | Mix | 1 |
| 105 | 0.3405 | 367.63 | 855.470 | 286.1125 | 0.5405 | 84.7457 | 1.04555 | Liq | −4.61° F. |
| 106 | 0.0627 | 157.30 | 2,100.000 | 106.9089 | 0.2248 | 68.0023 | 0.68157 | Liq | −457° F. |
| 108 | 0.5071 | 366.54 | 823.470 | 450.3211 | 0.7527 | 139.6184 | 1.61359 | Mix | 0.6515 |
| 109 | 0.8065 | 369.63 | 825.470 | 765.3679 | 1.1577 | 245.9420 | 0.61729 | Mix | 0 |
| 110 | 0.5900 | 367.43 | 823.470 | 537.4949 | 0.8648 | 169.0027 | 2.23087 | Mix | 0.4712 |
| 111 | 0.8122 | 367.43 | 823.470 | 761.6820 | 1.1540 | 244.2280 | 1.17978 | Mix | 0 |
| 112 | 0.3405 | 367.43 | 823.470 | 285.8603 | 0.5403 | 84.5674 | 1.05109 | Mix | 1 |
| 113 | 0.3405 | 367.43 | 823.470 | 285.8603 | 0.5403 | 84.5674 | 1.04555 | Mix | 1 |
| 114 | 0.3405 | 367.43 | 823.470 | 285.8603 | 0.5403 | 84.5674 | 0.00555 | Mix | 1 |
| 129 | 0.8100 | 74.31 | 2,075.000 | −8.9793 | 0.0560 | 43.0535 | 1.00000 | Liq | −271.97° F. |
| 138 | 0.5071 | 258.79 | 25.900 | 919.4504 | 1.6522 | 142.2120 | 1.68157 | Vap | 52.5° F. |
| 202 | 0.0627 | 342.43 | 2,090.000 | 278.5200 | 0.4947 | 99.6528 | 0.68157 | Liq | −237.53° F. |
| 203 | 0.1675 | 447.77 | 2,080.000 | 400.9311 | 0.6436 | 145.3151 | 1.05716 | Liq | −122.57° F. |
| 205 | 0.5071 | 444.43 | 826.470 | 938.9822 | 1.3134 | 337.4582 | 2.24249 | Mix | 0 |
| 206 | 0.5071 | 444.43 | 826.470 | 938.9822 | 1.3134 | 337.4582 | 1.32829 | Mix | 0 |
| 207 | 0.5071 | 444.43 | 826.470 | 938.9822 | 1.3134 | 337.4582 | 0.62890 | Mix | 0 |
| 208 | 0.5071 | 444.43 | 826.470 | 938.9822 | 1.3134 | 337.4582 | 0.28530 | Mix | 0 |
| 209 | 0.5071 | 411.51 | 824.470 | 670.1931 | 1.0113 | 225.3772 | 0.28530 | Mix | 0.3634 |
| 210 | 0.5071 | 354.43 | 823.470 | 403.2949 | 0.6954 | 122.3300 | 1.32829 | Mix | 0.7136 |
| 300 | 0.8100 | 425.66 | 2,060.000 | 684.3149 | 0.9891 | 252.3685 | 2.18533 | Mix | 0 |
| 301 | 0.8100 | 734.80 | 2,045.000 | 990.3993 | 1.2920 | 401.3270 | 2.18533 | Vap | 309.3° F. |
| 302 | 0.0627 | 425.66 | 2,080.000 | 391.0312 | 0.6061 | 154.4038 | 0.68157 | Liq | −187.21° F. |
| 303 | 0.1264 | 596.18 | 2,045.000 | 720.1774 | 0.9533 | 303.7152 | 1.73873 | Mix | 0.7508 |
| 304 | 0.1264 | 440.31 | 2,080.000 | 397.0504 | 0.6305 | 148.0443 | 1.73873 | Liq | −146.31° F. |
| 305 | 0.1264 | 585.12 | 2,060.000 | 603.1292 | 0.8418 | 244.5094 | 1.73873 | Mix | 1 |
| 308 | 0.5071 | 528.31 | 2,045.000 | 870.6653 | 1.1696 | 343.7359 | 3.92406 | Mix | 0 |
| 316 | 0.5071 | 867.83 | 833.470 | 1,237.2642 | 1.5855 | 494.5981 | 2.24249 | Vap | 422.6° F. |
| 408 | 0.5071 | 1,076.42 | 2,025.000 | 1,353.0605 | 1.5703 | 618.3190 | 3.92406 | Vap | 548.9° F. |
| 410 | 0.5071 | 1,075.00 | 1,975.000 | 1,353.0605 | 1.5730 | 616.9193 | 3.92406 | Vap | 549.6° F. |
| 411 | 0.5071 | 867.83 | 833.470 | 1,237.2642 | 1.5855 | 494.5981 | 3.92406 | Vap | 422.6° F. |
| 412 | 0.5071 | 867.83 | 833.470 | 1,237.2642 | 1.5855 | 494.5981 | 1.68157 | Vap | 422.6° F. |
| | | | | Heat Source | | | | | |
| 600 | GAS | 1,742.00 | 16.693 | 623.4416 | 0.6717 | 293.3330 | 6.55814 | Vap | 1600.2° F. |
| 601 | GAS | 11,200.00 | 16.693 | 452.5477 | 0.5827 | 168.5912 | 12.1129 | Vap | 1058.2° F. |
| 602 | GAS | 669.72 | 16.621 | 296.2718 | 0.4698 | 70.8538 | 12.1129 | Vap | 528° F. |
| 603 | GAS | 503.85 | 16.513 | 249.8887 | 0.4259 | 47.2638 | 12.1129 | Vap | 362.4° F. |
| 605 | GAS | 610.12 | 16.549 | 279.4702 | 0.4548 | 61.8212 | 12.1129 | Vap | 468.6° F. |
| 610 | GAS | 503.85 | 16.513 | 249.8887 | 0.4259 | 47.2638 | 5.55472 | Vap | 362.4° F. |
| 611 | GAS | 507.09 | 16.693 | 250.7831 | 0.4260 | 48.0717 | 5.55472 | Vap | 365.2° F. |
| 638 | GAS | 503.85 | 16.513 | 249.8887 | 0.4259 | 47.2638 | 6.55814 | Vap | 362.4° F. |

TABLE 2-continued

System Point Summary for Ammonia/Water Working Fluid

| Pt. | X lb/lb | T ° F. | P psia | H Btu/lb | S Btu/lb-R | Ex Btu/lb | G rel G/G = 1 | Ph. lb/lb | Wetness or T ° F. |
|---|---|---|---|---|---|---|---|---|---|
| | | | | | Coolant | | | | |
| 50 | Water | 51.70 | 14.693 | 19.8239 | 0.0394 | 0.0948 | 13.7800 | Liq | −160.25° F. |
| 51 | Water | 51.80 | 24.693 | 19.9498 | 0.0396 | 0.1232 | 13.7800 | Liq | −187.56° F. |
| 52 | Water | 120.68 | 14.693 | 88.7727 | 0.1659 | 3.4400 | 13.7800 | Liq | −91.28° F. |
| 53 | Water | 51.70 | 14.693 | 19.8239 | 0.0394 | 0.0948 | 12.5510 | Liq | −160.25° F. |
| 54 | Water | 51.80 | 24.693 | 19.9498 | 0.0396 | 0.1232 | 12.5510 | Liq | −187.56° F. |
| 55 | Water | 97.16 | 14.693 | 65.2741 | 0.1246 | 1.3800 | 12.5510 | Liq | −114.8° F. |

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that maybe made which do not depart from the scope and spirit of the invention as described above and claimed hereafter.

I claim:

1. A power system comprising:

a vaporization subsystem, an energy extraction subsystem, and a Condensation-Thermal Compression Subsystem (CTCSS), a two cycle heating and separating subsystem, where:

the vaporization subsystem is designed to fully heat a combined lean stream, which is then combined with a combined rich stream to form the single composition of a multi-component working fluid BWC stream which is then fully vaporized, the energy extraction subsystem is designed to convert a portion of thermal energy in the fully vaporized stream of a single composition of a multi-component working fluid BWC stream to useable energy in two stages with a portion of an intermediate spent stream being diverted to heat a lean and rich stream formed in the CTCSS in the heating and separating subsystem and to form second rich and lean stream, the CTCSS is designed to convert the spent BWC stream into a fully condensed lean stream and fully condensed rich stream using one or more external coolant streams, and the two cycle heating and separating subsystem is designed to support two interacting thermodynamically different working fluid cycles, a lean stream cycle and a rich stream cycle.

2. A method comprising the steps of:

forwarding a fully vaporized basic working composition stream to an energy extraction subsystem, where a portion of its thermal energy is converted into a usable form of energy in a two stage process to produce a spent basic working composition stream and a diverted partially spent basic working composition stream, forwarding the spent stream to a Condensation-Thermal Compression Subsystem (CTCSS), where the spent stream is divided and cooled in a series of heat exchange, separation, throttling and pressurizing steps to form a fully condensed first lean stream and a fully condensed first rich stream using one or more external coolant stream, using the diverted partially spent basic working composition stream to form a second rich stream and a second lean stream, combining the second rich stream with the first rich stream to form a combined rich stream, heating the combined rich stream with heat derived from the diverted partially spent basic working composition stream and streams derived therefrom, heating the first lean stream with heated derived from the diverted partially spent basic working composition stream and streams derived therefrom, combining the heated first lean stream with the second lean stream to form a combined lean stream, heating the combined lean stream in a lower portion of the vaporization subsystem, combining the heated combined lean stream with the combined rich stream at a mid-location of the vaporization subsystem to form a basic working composition stream composition stream, and fully vaporizing the basic working composition stream in top portion of the vaporization subsystem using an external heat source stream.

3. The method of claim 2, wherein in the vaporization subsystem, an initial combustion gas stream is mixed with a portion of the spent combustion gas stream to form a combustion gas stream having a temperature below a temperature that cause undue stress on the heat exchange elements of the vaporization subsystem.

4. The method of claim 2, wherein the external heat source stream is a combustion gas stream.

5. The method of claim 4, wherein the combustion gas stream is derived from the combustion of a low value fuel.

* * * * *